US009718596B1

(12) United States Patent
Russell et al.

(10) Patent No.: US 9,718,596 B1
(45) Date of Patent: Aug. 1, 2017

(54) BULK BOX DAMPENING SYSTEMS

(71) Applicant: Amazon Technologies, Inc., Seattle, WA (US)

(72) Inventors: Paul Grady Russell, Campbell, CA (US); Jeffrey A. Henderson, San Jose, CA (US); Lona Phitsamay, Fremont, CA (US); Joselito T. Crespo, Burlingame, CA (US)

(73) Assignee: Amazon Technologies, Inc., Seattle, WA (US)

( * ) Notice: Subject to any disclaimer, the term of this patent is extended or adjusted under 35 U.S.C. 154(b) by 0 days.

(21) Appl. No.: 14/934,096

(22) Filed: Nov. 5, 2015

Related U.S. Application Data

(62) Division of application No. 13/231,754, filed on Sep. 13, 2011, now Pat. No. 9,199,762.

(51) Int. Cl.
*B65D 81/05* (2006.01)
*B65D 19/00* (2006.01)

(52) U.S. Cl.
CPC ..... *B65D 81/05* (2013.01); *B65D 19/0004* (2013.01)

(58) Field of Classification Search
CPC ..... B65B 39/00; B65B 5/108; B65D 5/5213; B65D 5/724; B65D 81/05; B65D 19/0004
USPC ..... 229/122.1, 120.38, 122.34, 122.32; 53/535, 536, 473, 574, 475, 248, 245; 206/584, 499, 514; 221/311, 33, 303
See application file for complete search history.

(56) References Cited

U.S. PATENT DOCUMENTS

| | | | | |
|---|---|---|---|---|
| 877,757 | A * | 1/1908 | Comings | B65D 5/248 229/122.34 |
| 1,272,411 | A | 7/1918 | Fitz Gerald | |
| 1,645,771 | A | 10/1927 | Pillsbury | |
| 1,935,923 | A * | 11/1933 | Thoke | F25D 3/125 206/205 |
| 2,110,480 | A * | 3/1938 | Barlow | B65D 5/324 206/392 |
| 4,805,765 | A | 2/1989 | Barrett et al. | |
| 5,020,719 | A | 6/1991 | Roth et al. | |
| 5,450,998 | A * | 9/1995 | Esse | B65D 5/606 229/117.27 |
| 7,377,420 | B2 | 5/2008 | Gardner | |
| 7,565,971 | B2 | 7/2009 | Jenkins et al. | |
| 2001/0048022 | A1 | 12/2001 | Zoeckler | |
| 2010/0189961 | A1* | 7/2010 | Bugas | B31B 1/74 428/182 |
| 2012/0006818 | A1 | 1/2012 | Fester et al. | |

OTHER PUBLICATIONS

Office Action for U.S. Appl. No. 13/231,754, mailed on Nov. 3, 2014, Paul Grady Russell, "Bulk Box Dampening Systems", 9 pages.
Final Office Action for U.S. Appl. No. 13/231,754, mailed on Mar. 30, 2015, Paul Grady Russell, "Bulk Box Dampening Systems", 10 pages.

* cited by examiner

*Primary Examiner* — Christopher Demeree
(74) *Attorney, Agent, or Firm* — Lee & Hayes, PLLC

(57) ABSTRACT

A packaging assembly comprises a bulk box having a shock absorber to dampen a kinetic energy of product being dispensed from a conveyor system. The shock absorber may be a rectangular sheet shock absorber disposed diagonally in the bulk box, a shuttle tray shock absorber disposed in an opening of the bulk box, a deflector net disposed in an opening of the bulk box, or a inflatable bag shock absorber disposed in the bulk box, for example.

17 Claims, 12 Drawing Sheets

BULK BOX DAMPENING SYSTEMS

CROSS REFERENCE TO RELATED APPLICATIONS

This is a divisional application which claims priority to commonly assigned, co-pending U.S. patent application Ser. No. 13/231,754, filed Sep. 13, 2011. Application Ser. No. 13/231,754 is fully incorporated herein by reference.

BACKGROUND

Existing distribution centers process vast amounts of product. Efficiently processing the product greatly effects the final cost of the product to customers. To process a large quantity of product, distribution centers utilize mechanical handling equipment which can be rough on the product. For example, a distribution center (e.g., a fulfillment center) may transport product via a conveyor system to be dispensed into a bulk box (e.g., a Gaylord container). The bulk box filled with product is subsequently shipped to a package delivery company which then delivers the product to a customer. While this approach may deliver product to a customer in a very short period of time, it is very coarse and susceptible to yielding damaged products. For example, the product may be packaged to be shipped in its own container and the product damage may be a result of the product falling from a high drop onto a base of the bulk box. In addition, the product may sustain damage as a result of product-to-product impacts. For example, when a product at the bottom of the bulk box is hit by an edge of a larger heavier product dropped into the container from above. The damaged products are replaced free of charge to the customer. Replacing damaged products reduces the efficiency of a distribution center. As such, the more damaged products a distribution center produces the lower its efficiency, which ultimately increases the final price of the product to the customer.

Accordingly there remains a need in the art for improved systems and methods of handling products in a distribution center that reduce the amount of damaged products and increases distribution center efficiency.

BRIEF DESCRIPTION OF THE DRAWINGS

The detailed description is described with reference to the accompanying figures. The use of the same reference numbers in different figures indicates similar or identical items.

DETAILED DESCRIPTION

Overview

Figure 1A:
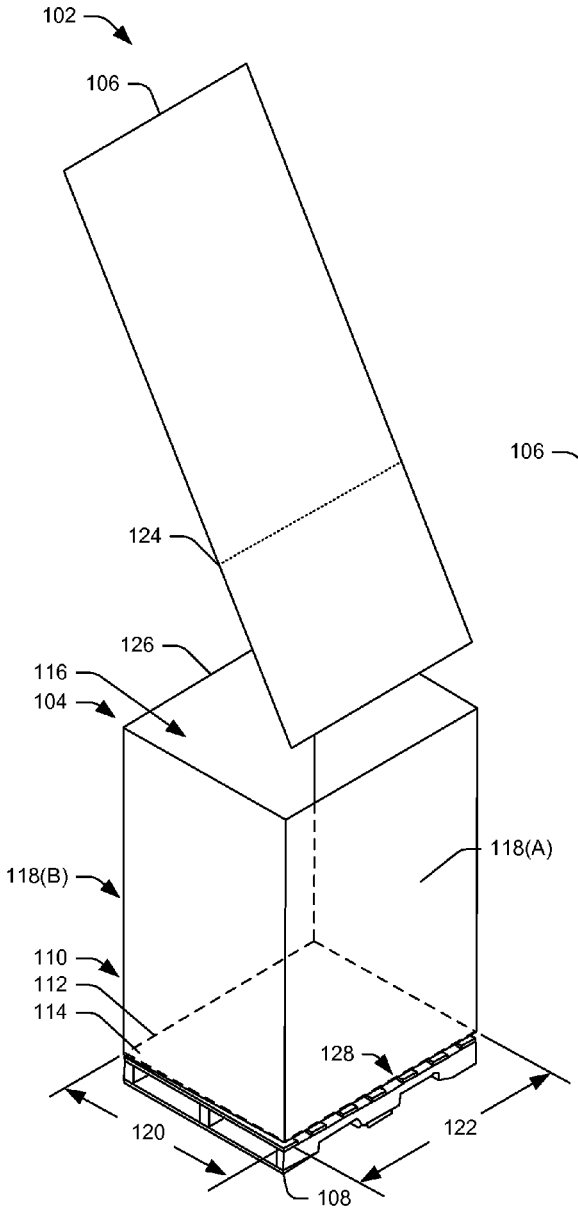
FIG. 1A illustrates an example packaging assembly including a bulk box and a rectangular sheet shock absorber.

This disclosure is directed to packaging assemblies having a shock absorber and a method of using the same. The shock absorbers may be installed in a bulk box (e.g., a Gaylord container) to dampen a kinetic energy of product being received by the bulk box. The shock absorbers may be a folding deflector sheet, pneumatic shuttle tray, a grid deflector, an air bag, or the like suitable for dampening a kinetic energy of product being received by the bulk box.

In one embodiment, the shock absorbers may comprise a planar sheet disposed diagonally in a bulk box. The planar sheet may be formed of a corrugated material and may have a fold line disposed perpendicular to the direction of corrugation. The fold line may be a deformation that provides a location in the planar sheet having a lower resistance to bending as compared to areas of the planar sheet without a fold line. By way of example and not limitation, the fold line may be a kiss cut, a score, a crease, a perforation, a notch, a thin cross-section, or any other feature suitable for providing a lower resistance to bending as compared to an area of the planar sheet without a deformation. The fold line may fold or bend as a result of an accumulation of product dispensed from the pick-up point and provide for the planar sheet to deform and move down inside the bulk box once a predetermined load of product rests on the planar sheet. For example, a fold line may be disposed a distance from an edge of the planar sheet that is about equal to a width of the bottom surface of the bulk box. As such, the planar sheet may fold at the fold line resulting in a portion of the planar sheet having about the same width as the width of bulk box. In this way, the folded portion of the planar sheet lays parallel with the bottom of the bulk box, leaving space in the bulk box to receive additional product. Similarly, a remaining portion of the planar sheet, on the other side of the fold line away from the portion having about the same width as the width of the bulk box, may subsequently lay parallel with the wall of the bulk box as a result of the planar sheet folding at the fold line.

In another embodiment, the shock absorbers may comprise a shuttle tray disposed in an opening of the bulk box. The shuttle tray may be formed of a corrugated material and may include a rim arranged around a bottom. The rim may comprise flaps having a depth of at least about 6 to at most about 8 inches (15 to 20 centimeters) that provide a coefficient of static friction between the rim of the shuttle tray and the wall of the bulk box. The bottom may have a length and a width that are about equal to a length and a width of the bottom of a bulk box, respectively. The bottom of the shuttle tray may include apertures to relieve an air pressure from between the bottom of the shuttle tray and the bottom of the bulk box as a result of an accumulation of product on top of the shuttle tray.

In another embodiment, the shock absorbers may comprise a deflector net disposed in an opening of the bulk box. The deflector net may have a frame formed of a corrugated material and may include bands arranged across the frame. The frame of the deflector net may have a length and a width that are about equal to a length and a width of an opening of a bulk box, respectively. The bands of the deflector net may deflect product dispensed from a pick-up point at the opening of the bulk box.

In yet another embodiment, the shock absorbers may comprise an inflatable bag filled with a gas disposed in the bulk box. The inflatable bag may fill a bottom portion of the bulk box. The inflatable bag may deflect product dispensed from a pick-up point and have pressure relief valve that relieves an air pressure from inside the inflatable bag as a result of an accumulation of product on top of the inflatable bag. Alternatively, or in addition, the inflatable bag may have a pop-off valve, small perforations in the inflatable bag, a wall thickness suitable to be punctured by product resting on the inflatable bag, a wall thickness suitable to burst (e.g., rupture) under a predetermined load of product resting on the inflatable bag, etc. Subsequent to the loading of the bulk box and the air exhausting from the inflatable bag, the inflatable bag may remain in a bottom of the bulk box.

While the foregoing embodiments of shock absorbers have been described, these are merely examples of shock absorbers that can be used and other shock absorbers may also be used.

Because the shock absorbers are quickly and easily implemented in a distribution center, the packaging assemblies having a shock absorber increase the distribution centers efficiency. For example, a user may simply install a shock absorber into a bulk box and position the packaging assembly proximate to a pick-up point of a conveyor system to deflect and/or dampen a kinetic energy of the product dispensed from the pick-up point. In this way, the packaging assembly having the shock absorber reduces an amount of damaged products. Further, because the packaging assembly having the shock absorber is easily positioned proximate to the pick-up point, a processing of the distribution center remains streamlined and efficient. For example, because the packaging assembly having the shock absorber is easily positioned proximate to the pick-up point, the process of picking up product at pick-up points simply adds a process step of installing a shock absorber into a bulk box. The cost savings in reducing damaged product far outweighs the time and expense of employing a shock absorber. As such, the processing of the distribution center remains streamlined and efficient (i.e., only one extra step is added to the process of picking up product at a pick-up point) and likewise the processing of the distribution center remains streamlined and efficient.

While the illustrated embodiments show product comprising a single item packaged to be shipped in its own container, the product may be of multiple items packaged to be shipped together. Further, the items may be any type of goods to be distributed to retailers, wholesalers, or directly to customers. For example, the items may be electronics (e.g., computers, electronic book devices, media players, etc.) or other items packaged to be shipped in its own container.

Example Shock Absorbing Packaging Assembly Systems

Figure 1B:
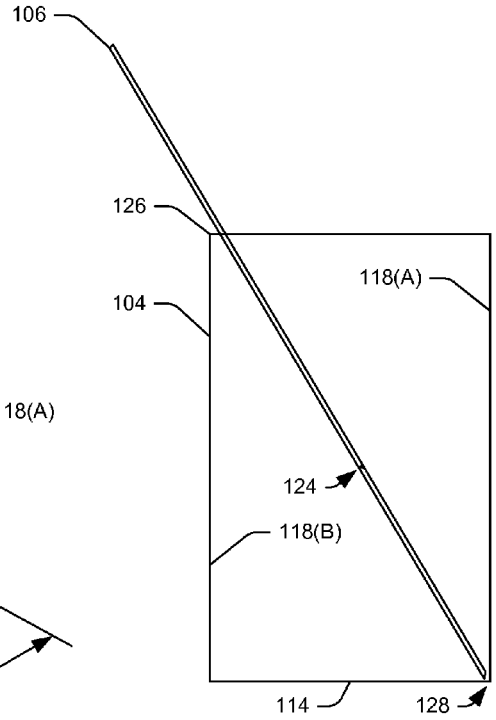
FIG. 1B illustrates the rectangular sheet shock absorber arranged in the bulk box.

FIG. 1A illustrates an example packaging assembly 102 including a bulk box 104 and a rectangular sheet shock absorber 106, and FIG. 1B illustrates the rectangular sheet shock absorber 106 arranged in the bulk box 104. The bulk box 104 may be disposed on a pallet 108. A bulk box 104 may be formed of wood, metal, plastic, paper, composite, etc. In one example, the bulk box 104 may be formed of a corrugated material. For example the bulk box 104 may be formed of a corrugated fiberboard (e.g., single wall, double wall, or triple wall corrugate fiberboard), a corrugated plastic, or a combination of the like (e.g., a corrugated plastic bottom and a corrugated fiberboard top). The bulk box 104 may be a bulk bin, a skid box, a tote box, a Gaylord box, or any other suitable bulk container. The bulk box 104 provides a suitable receptacle for storing and/or shipping bulk quantities of product. For example, a distribution center (e.g., a fulfillment center) of a retailer, may use a bulk box 104 to ship bulk quantities of product to a package delivery company where the package delivery company then ships the products as single shipments to customers. The bulk box 104 may have a wall 110 arranged around a perimeter 112 of a bottom 114 and may have an opening 116 opposite the bottom 114. The wall 110 may include a front wall 118(A) opposite a back wall 118(B) perpendicular to the bottom 114. The bottom 114 of the bulk box 104 may have a width 120 of about 33 inches (84 centimeters) and a length 122 of about 38 inches (96.5 centimeters). Further, the opening 116 may have about the same dimensions as the bottom 114. For example, the opening 116 may have a width of about 33 inches (84 centimeters) and a length of about 38 inches (96.5 centimeters). However, in other embodiments, the dimensions, proportions, shape, and configuration of the bulk box 104 may vary depending on a variety of factors, such as the product to be shipped, the volume of the product to be shipped, the size, shape, and layout of a facility of the distribution center, and requirements of the shipper, for example.

While FIGS. 1A and 1B illustrate a bulk box 104 having a generally rectangular cross-sectional shape, the bulk box 104 may be any shape suitable for storing and/or shipping bulk quantities of product. For example, the bulk box 104 may be circular shaped, octagonal shaped, square shaped, etc.

Figure 2C:
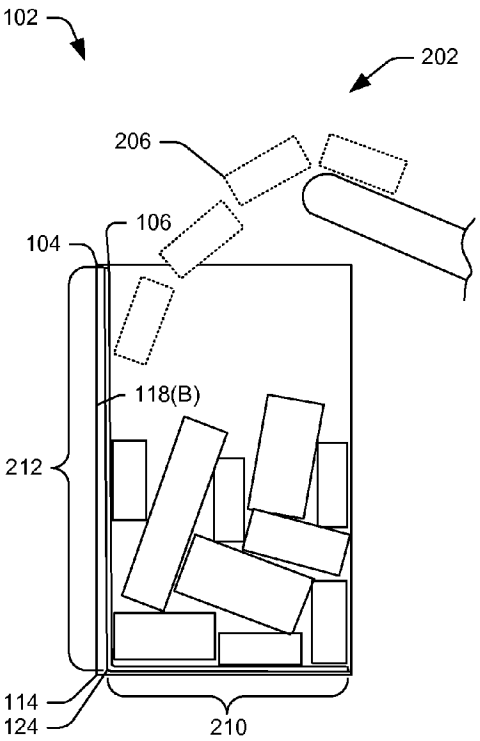
FIGS. 2A, 2B, and 2C illustrate an example implementation of the rectangular sheet shock absorber of FIGS. 1A and 1B.
Figure 2B:
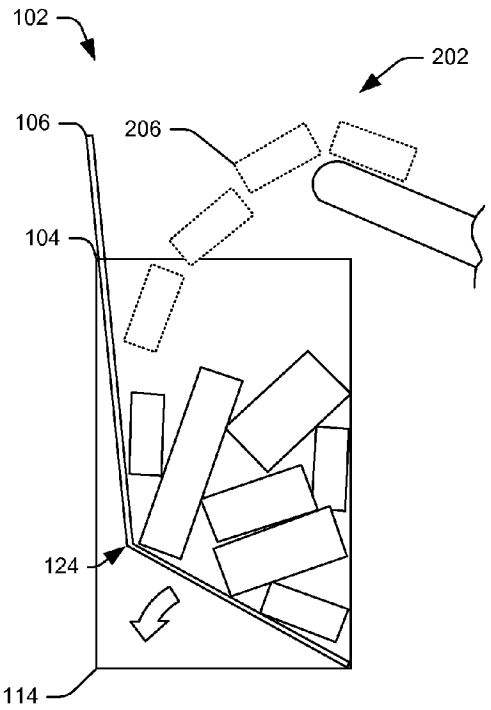
Figure 2A:
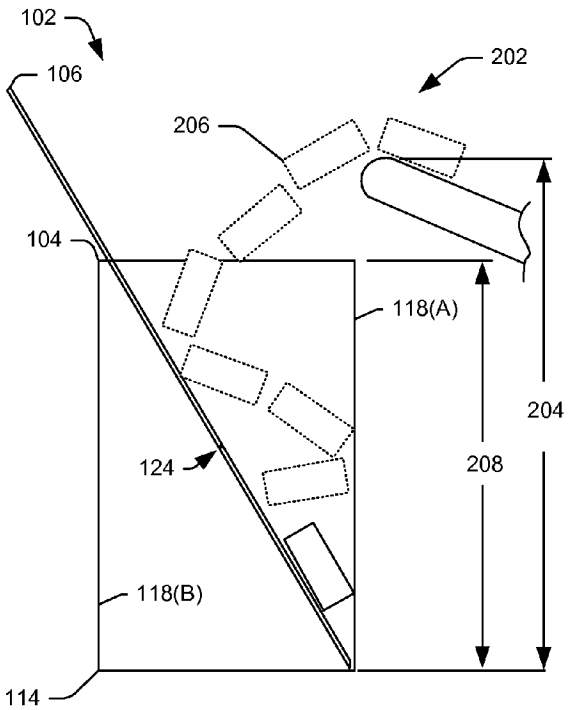

FIG. 1B illustrates the rectangular sheet shock absorber 106 arranged in the bulk box 104 to dampen a kinetic energy of a product dispensed from a pick-up point of a conveyor system (discussed in detail with respect to FIGS. 2A, 2B, and 2C). The rectangular sheet shock absorber 106 may be disposed diagonally in the bulk box 104. The rectangular sheet shock absorber 106 may have a fold line 124 arranged to fold as a result of an accumulation of product dispensed from a pick-up point. Further, the rectangular sheet shock absorber 106 may be disposed diagonally from a top edge 126 of the back wall 118(B) to a bottom corner 128 of the bottom 114 and the front wall 118(A). The top edge 126 of the wall 110 may define the opening 116 of the bulk box 104.

FIGS. 2A, 2B, and 2C illustrate an example implementation of the rectangular sheet shock absorber 106 of FIGS. 1A and 1B. FIG. 2A illustrates a pick-up point 202 of a conveyor system may have a height 204 of about (72 inches (183 centimeters)). The packaging assembly 102, including the bulk box 104 and the rectangular sheet shock absorber 106, may be positioned proximate to the pick-up point 202. For example, a user (e.g., a loader) may position the bulk box 104 and the rectangular sheet shock absorber 106 such that a product 206 dispensed from the pick-up point 202 accumulates in the bulk box 104. Specifically, a user may position the packaging assembly 102 such that the rectangular sheet shock absorber 106 is positioned to deflect product 206 as it enters the bulk box 104. For example, a user may position the rectangular sheet shock absorber 106 proximate to the pick-up point 202 to deflect product dispensed from the pick-up point 202 and allow the product 206 to subsequently slide gently down the rectangular sheet shock absorber 106 and into the bulk box 104. Because the product 206 is deflected by the rectangular sheet shock absorber 106 before hitting the bottom 114 of the bulk box 104, the product accumulating in the bulk box 104 has at least 48% less energy than product accumulating in a bulk box 104 without the rectangular sheet shock absorber 106. For example, because the product is deflected by the rectangular sheet shock absorber 106 before hitting the bottom 114 of the bulk container 104, the shock experienced by the product is about 30 gravitational forces (Gs) versus about 58 Gs if the product was not deflected. Further, because the product accumulates on top of the rectangular sheet shock absorber 106, reducing the drop height of the product, the shock experienced by a product falling on top of the accumulated product is about 23 Gs. FIG. 2A illustrates the bulk box 104 having a depth 208 of about 47 inches (120 centimeters). For example the front and back walls 118(A) and 118(B) of the bulk box 104 may have the depth 208 of about 47 inches (120 centimeters). However, in other examples the bulk box 104 may have a different depth.

FIG. 2B illustrates the fold line 124 arranged to fold (e.g., bend) as a result of an accumulation of product dispensed from the pick-up point 202. For example, the fold line 124 may be arranged to fold when a weight of the accumulated product overcomes a bending resistance of the rectangular sheet shock absorber 106. As the product accumulates on top of the rectangular sheet shock absorber 106, the weight of the accumulated product eventually being equal to a predetermined weight exceeds a bending resistance of the rectangular sheet shock absorber 106 and causes the rectangular sheet shock absorber 106 to be displaced down inside the bulk box 104. The predetermined weight may be chosen based on the size, shape, and type of products, the size, shape, and configuration of the bulk box 104, or the like. The bending resistance of the rectangular sheet shock absorber 106 may be set or adjusted by for example adjusting a depth of a crease made in the sheet, adjusting a depth of a score line, increasing or decreasing a number, length, or shape of perforations defining the fold line, or the like. FIG. 2C illustrates the rectangular sheet shock absorber 106 may fold at the fold line 124 and provide for the rectangular sheet shock absorber 106 to deform into a portion 210 of the rectangular sheet shock absorber 106 having about a same width as the width 120 of the bulk box 104. The folded portion 210 of the rectangular sheet shock absorber 106 may lay parallel with the bottom 114 of the bulk box 104. In this way, the folded portion 210, laying parallel with the bottom 114, makes more space in the bulk box 104 to receive additional product 206. Stated otherwise, because the folded portion 210 lays parallel with the bottom 114, the folded portion 210 provides for product 206 to continue to accumulate in the bulk box 104 as if the rectangular sheet shock absorber 106 was not installed in the bulk box 104. A remaining portion 212 of the rectangular sheet shock absorber 106, on the other side of the fold line 124, away from the folded portion 210, may subsequently lay parallel with the wall 110 of the bulk box 104 as a result of the rectangular sheet shock absorber 106 folding at the fold line 124. Specifically, the remaining portion 212 of the rectangular sheet shock absorber 106 may lay parallel with the back wall 118(B) of the bulk box 104.

Figure 3:
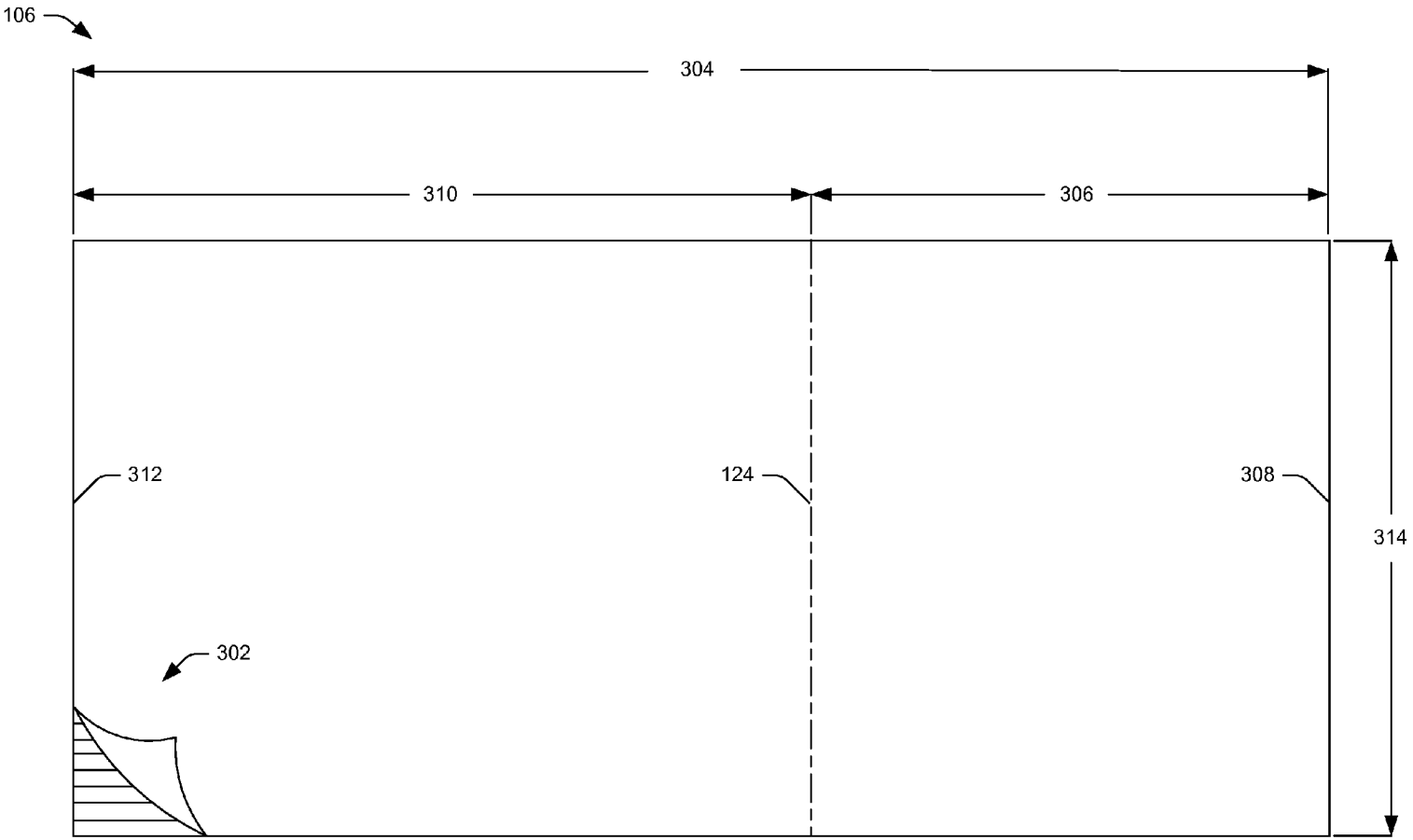
FIG. 3 is a top view of a rectangular sheet shock absorber.

FIG. 3 is a top view of a rectangular sheet shock absorber 106. The rectangular sheet shock absorber 106 may be formed of a corrugated material and have the fold line 124 disposed perpendicular to a direction of corrugation 302. The corrugated material may be a corrugated fiberboard or a corrugated plastic. Further, the rectangular sheet shock absorber 106 may be formed of Styrofoam or other foam based material to add additional shock absorption. In the embodiment where the rectangular sheet shock absorber 106 is formed of a corrugated fiberboard, the corrugated fiberboard may comprise a minimum edge crush test (ECT) strength of about 55 and may comprise a type C-flute profile. While FIG. 3 illustrates a type C-flute profile, the flute profile may be an A, B, D, F, E, N, or other type flute profile. The rectangular sheet shock absorber 106 may have a length 304 of about 80 inches (203 centimeters). The direction of corrugation 302 may be parallel to the length 304. For example, when looking in the length 304 direction, one can see through the flutes of the corrugation. The fold line 124 may be disposed a distance 306 of about 33 inches (84 centimeters) from a front edge 308 of the rectangular sheet shock absorber 106. The distance 306 may be about equal to the width 120 of the bottom 114 of the bulk box 104. The fold line 124 may also be disposed a distance 310 of about 47 inches (120 centimeters) from a back edge 312 of the rectangular sheet shock absorber 106. The distance 310 may be about equal to the depth 208 of the back wall 118(B) of the bulk box 104. The fold line 124 may be about a 3 point score. While FIG. 3 illustrates a single fold line 124 disposed a distance 310 from the back edge 312, multiple fold lines may be disposed proximate to the distance 310 from the back edge 312. For example, multiple fold lines may be arranged parallel to the fold line 124 on one and/or both sides of the fold line 124. Further, the parallel fold lines may be about a 3 point score or other point score number to provide for folding the rectangular sheet shock absorber 106 into the bulk box 104 as a result of an accumulation of product 206 dispensed from the pick-up point 202.

FIG. 3 further illustrates the rectangular sheet shock absorber 106 may have a width 314 of about 38 inches (96.5 centimeters) that is about equal to the length 122 of the bottom 114 of the bulk box 104. Because the rectangular sheet shock absorber 106 may have a width 314 that is about equal to the length 122 of the bottom 114 of the bulk box 104, the rectangular sheet shock absorber 106 keeps the product 206 on top of the rectangular sheet shock absorber 106. Stated otherwise, because the width 314 is about equal to the length 122 of the bulk box 104, this keeps product 206 from getting behind the rectangular sheet shock absorber 106 when installed in the bulk box 104. For example the rectangular sheet shock absorber 106 prevents product from falling behind the rectangular sheet shock absorber 106 during loading of the bulk box 104. While FIG. 3 illustrates the rectangular sheet shock absorber 106 comprising a single fold line 124 disposed perpendicular to a direction of corrugation 302, any number and/or orientation of fold lines are contemplated. For example, the rectangular sheet shock absorber 106 may include 2 additional fold lines arranged parallel to the direction of corrugation 302 and generally disposed along the full length 304. The 2 additional fold lines may provide for 2 flaps arranged along the length 304 of the rectangular sheet shock absorber to provide for keeping product from getting behind the rectangular sheet shock absorber 106.

Figure 4B:
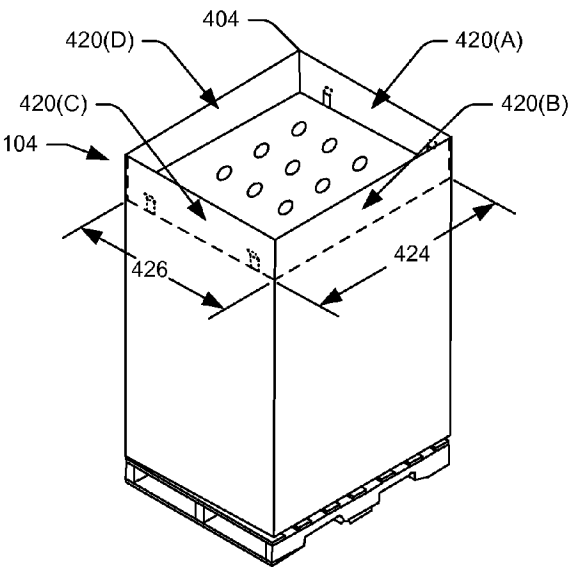
FIG. 4B illustrates the shuttle tray shock absorber arranged in the bulk box.
Figure 4A:
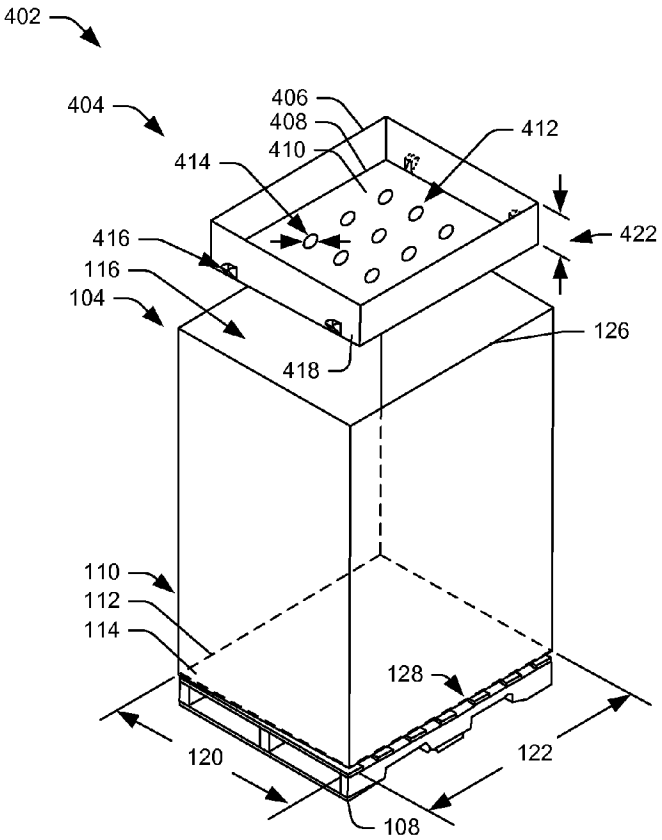
FIG. 4A illustrates an example packaging assembly including a bulk box and a shuttle tray shock absorber.

FIG. 4A illustrates an example packaging assembly 402 including a bulk box 104 and a shuttle tray shock absorber 404, and FIG. 4B illustrates the shuttle tray shock absorber 404 arranged in the bulk box 104. The shuttle tray shock absorber 404 may have a rim 406 arranged around a perimeter 408 of a bottom 410. The bottom 410 of the shuttle tray shock absorber 404 may include apertures 412. The apertures 412 may relieve an air pressure from between the bottom 410 of the shuttle tray shock absorber 404 and the bottom 114 of the bulk box 104. For example, the apertures 412 may provide a pneumatic damping effect that creates a resistance preventing the shuttle tray shock absorber 404 from being displaced too quickly. The air pressure between the bottom 410 of the shuttle tray shock absorber 404 and the bottom 114 of the bulk box 104 may be a result of an accumulation of product 206 dispensed from the pick-up point 202. Further, air pressure between the bottom 410 of the shuttle tray shock absorber 404 and the bottom 114 of the bulk box 104 may be a result of individual impacts of product 206 on the bottom 410 of the shuttle tray shock absorber 404. While FIGS. 4A and 4B illustrate 9 apertures 412, other quantity of apertures 412 are contemplated. For example, the bottom 410 of the shuttle tray shock absorber 404 may have any quantity of apertures 412 ranging between about 4 to 9 apertures 412. Further, while FIGS. 4A and 4B illustrate the apertures 412 having a diameter 414 of about 1 inch (2.5 centimeters), the apertures 412 may have any sized diameter 414 ranging between about 0.5 inches (1.3 centimeters) to about 3 inches (7.6 centimeters). The shuttle tray shock absorber 404 may also comprise tabs 416 arranged around the perimeter 408 of the bottom 410 of the shuttle tray shock absorber 404. The tabs 416 may protrude from an outside surface 418 of the rim 406 to provide an interference between the shuttle tray shock absorber 404 and the wall 110 of the bulk box 104. The rim 406 may comprise flaps 420(A), 420(B), 420(C), and 420(D). The flaps 420(A)-420(D) may have a depth 422 of at least about 6 to at most about 8 inches (15 to 20 centimeters).

FIG. 4B illustrates the shuttle tray shock absorber 404 disposed in the opening 116 and coplanar with the bottom 114 of the bulk box 104. The bottom 410 of the shuttle tray shock absorber 404 may have a length 424 and a width 426 that are about equal to the length 122 and the width 120 of the bottom 114 of the bulk box 104, respectively. For example, the length 424 may be about 38 inches (96.5 centimeters) and the width 426 may be about 33 inches (84 centimeters). The rim 406 of the shuttle tray shock absorber 404 may provide a coefficient of static friction between the rim 406 of the shuttle tray shock absorber 404 and the wall 110 of the bulk box 104. For example, the rim 406 may interfere with the wall 110 to provide a coefficient of static friction between the rim 406 and the wall 110.

Figure 5C:
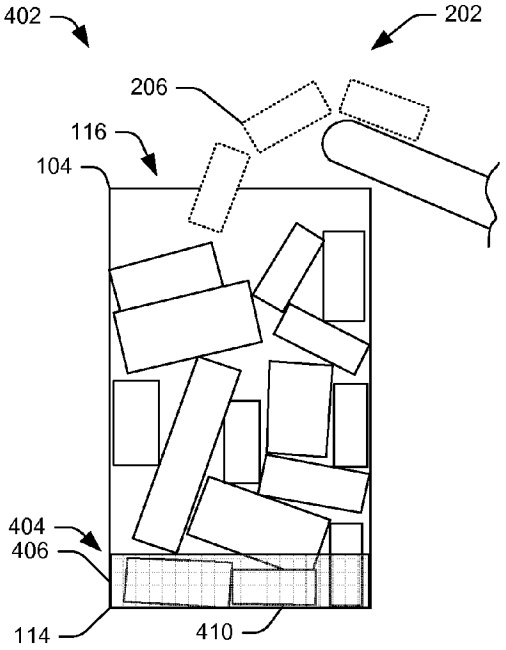
FIGS. 5A, 5B, and 5C illustrate an example implementation of the shuttle tray shock absorber of FIGS. 4A and 4B.
Figure 5B:
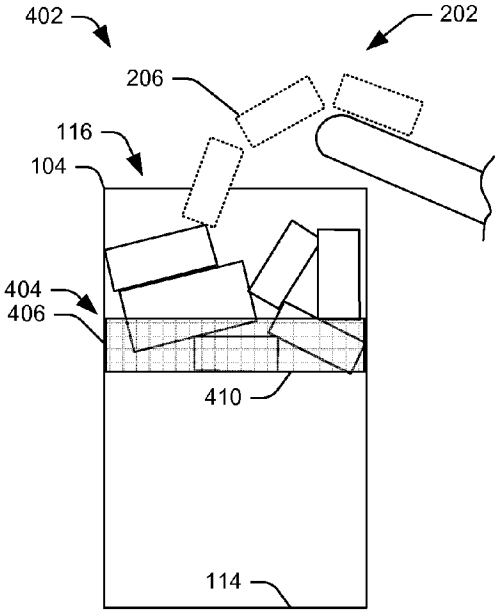
Figure 5A:
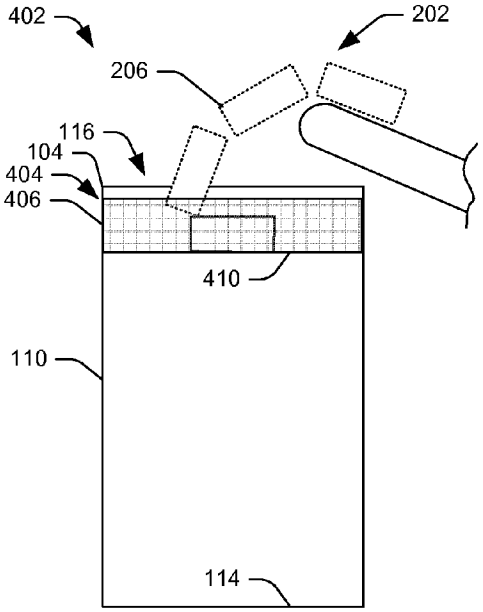

FIGS. 5A, 5B, and 5C illustrate an example implementation of the shuttle tray shock absorber 404 of FIGS. 4A and 4B. Similar to FIG. 2A, FIG. 5A illustrates a packaging assembly 402, including the bulk box 104 and the shuttle tray shock absorber 404, may be positioned proximate to a pick-up point 202. For example, a user (e.g., a loader) may position the bulk box 104 and the shuttle tray shock absorber 404 such that a product 206 dispensed from the pick-up point 202 accumulates in the bulk box 104. Specifically, a user may position the packaging assembly 102 such that the shuttle tray shock absorber 404 is positioned to catch product 206 at the opening 116 of the bulk box 104. For example, a user may position the shuttle tray shock absorber 404 to deflect and then catch the product 206 at the opening 116. The shuttle tray shock absorber 404 may continue to catch the product 206 at the opening 116 until a weight of the accumulated product 206 overcomes a coefficient of static friction between the rim 406 of the shuttle tray shock absorber 404 and the wall 110 of the bulk box 104.

FIG. 5B illustrates the shuttle tray shock absorber 404 displaced down inside the bulk box 104 as a result of an accumulation of product 206 dispensed from the pick-up point 202. The shuttle tray shock absorber 404 provides for being displaced down inside the bulk box 104 and catch product 206 proximate to the opening 116 of the bulk box 104. For example, subsequent to the weight of the accumulated product 206 overcoming a coefficient of static friction between the rim 406 of the shuttle tray shock absorber 404 and the wall 110 of the bulk box 104, the shuttle tray shock absorber 404 is displaced down inside the bulk box 104. Further, and as discussed above with respect to FIGS. 4A and 4B, the apertures 412 may relieve an air pressure from between the bottom 410 of the shuttle tray shock absorber 404 and the bottom 114 of the bulk box 104 as the shuttle tray shock absorber 404 is being displaced. The apertures 412 may provide a pneumatic damping effect that creates a resistance preventing the shuttle tray shock absorber 404 from being displaced too quickly. Individual impacts of product 206 on the bottom 410 of the shuttle tray shock absorber 404 and/or on accumulated product 206 may also displace the shuttle tray shock absorber 404. Again, the apertures 412 may relieve an air pressure from between the bottom 410 of the shuttle tray shock absorber 404 and the bottom 114 of the bulk box 104 as a result of the shuttle tray shock absorber 404 being displaced from the individual impacts.

FIG. 5 C illustrates the shuttle tray shock absorber 404 may continue to be displaced down inside the bulk box 104 as a result of an accumulation of product 206 dispensed from the pick-up point 202. For example, the shuttle tray shock absorber 404 may continue to catch product 206 proximate to the opening 116 of the bulk box 104 until the bottom 410 of the shuttle tray shock absorber 404 is parallel with the bottom 114 of the bulk box 104.

Figure 6B:
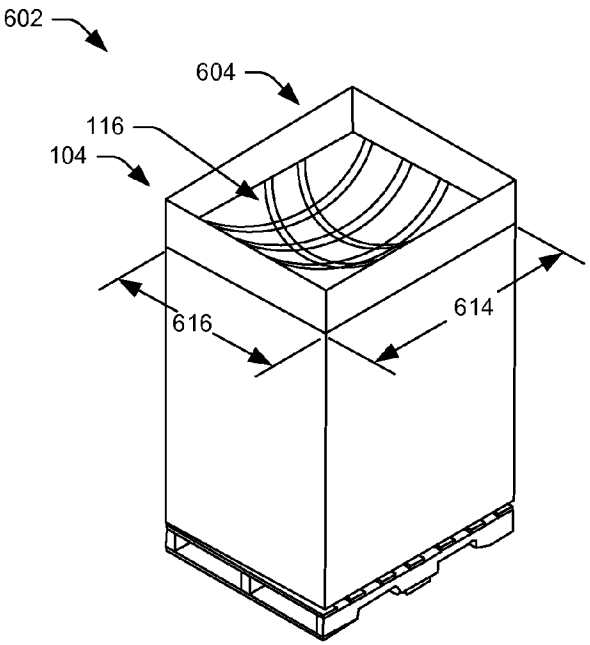
FIG. 6B illustrates the deflector net disposed in the opening of the bulk box.
Figure 6A:
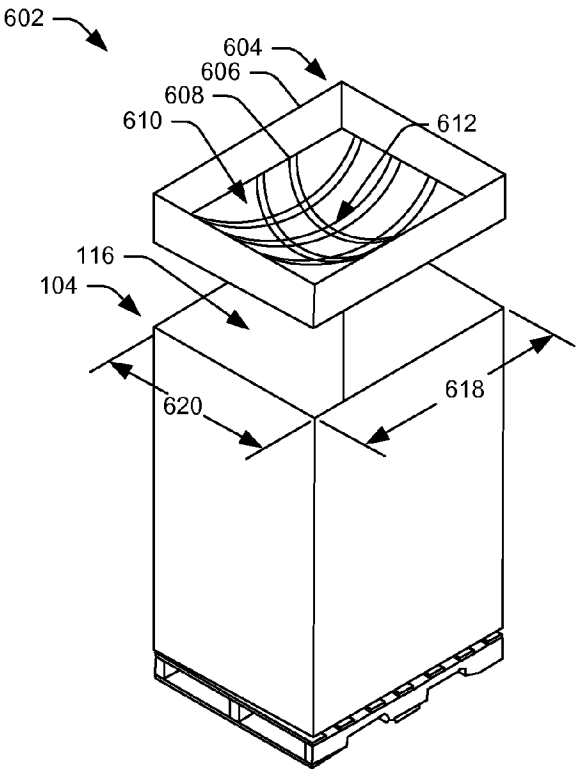
FIG. 6A illustrates an example packaging assembly including a bulk box and a deflector net.

FIG. 6A illustrates an example packaging assembly 602 including a bulk box 104 and a deflector net 604, and FIG. 6B illustrates the deflector net 604 disposed at the opening 116 of the bulk box 104. The deflector net 604 may comprise a frame 606 having a perimeter 608 defining an opening 610. The frame 606 may be formed of wood, metal, plastic, paper, composite, etc. Further, the frame 606 may be formed of a corrugated material. For example the frame 606 may be formed of a corrugated fiberboard (e.g., double wall or triple wall corrugate fiberboard) or a corrugated plastic. The frame 606 may provide for removably coupling with the top edge 126 of the wall 110 of the bulk box 104 and provide for the deflector net 604 to cap the bulk box 104. For example, the frame 606 may cooperate with the top edge 126 so that the deflector net 604 rests on top of the bulk box 104 at the opening 610. The deflector net 604 may include bands 612 arranged across the opening 610 of the frame 606. The bands 612 may deflect product 206 dispensed from the pick-up point 202 at the opening 116 of the bulk box 104 (explained in detail with respect to FIG. 7). The frame 606 of the deflector net 604 may have a length 614 of about 38 inches (96.5 centimeters) and a width 616 of about 33 inches (84 centimeters). The length 614 and width 616 may be about equal to a length 618 and a width 620 of the opening 116 of the bulk box 104, respectively.

The bands 612 may be strips formed of plastic, metal, or fiber. The bands 612 may be narrow strips having a width of about 0.5 inches (1.3 centimeters) and/or the bands may be wider strips having a width of about 1.5 inches (3.8 centimeters). While FIG. 6 illustrates 5 bands 612 arranged across the frame 606, any quantity of bands 612 may be arranged across the frame 606. For example, there may be anywhere from about 3 bands 612 up to about 8 bands 612 arranged across the frame 606.

Figure 7:
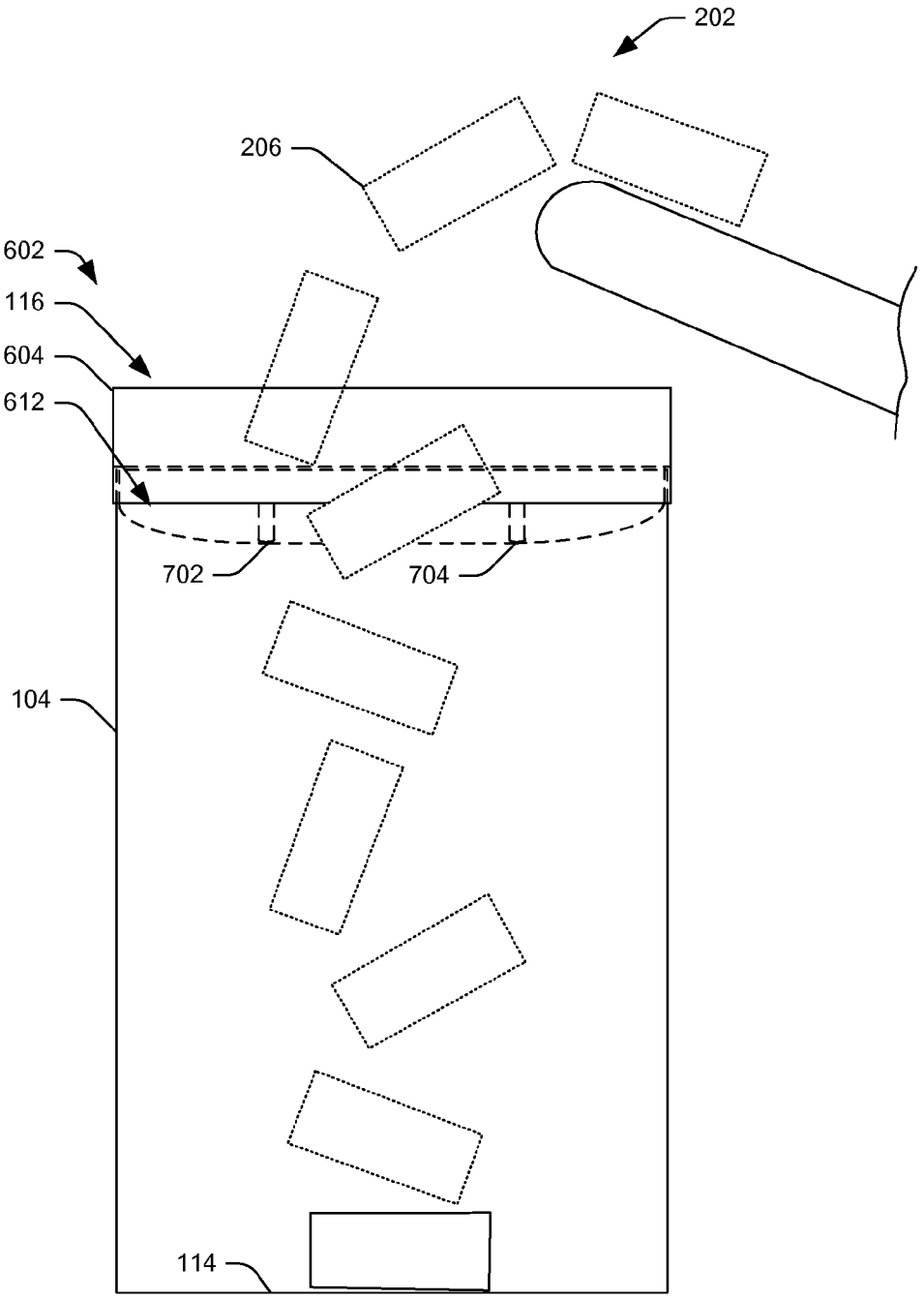
FIG. 7 illustrates an example implementation of the deflector net of FIGS. 6A and 6B.

FIG. 7 illustrates an example implementation of the deflector net 604 of FIGS. 6A and 6B. FIG. 7 illustrates the packaging assembly 602 of FIGS. 6A and 6B positioned proximate to the pick-up point 202. The packaging assembly 602 may be positioned proximate to the pick-up point 202 to accumulate product 206 in the bulk box 104. Specifically, a user may position the packaging assembly 602 such that the bands 612 of the deflector net 604 deflect the product 206 causing the product 206 to tumble into the bulk box 104. FIG. 7 illustrates the product 206 may be deflected at a point 702 and/or at point 704 causing the product 206 to tumble into the bulk box 104.

Figure 8A:
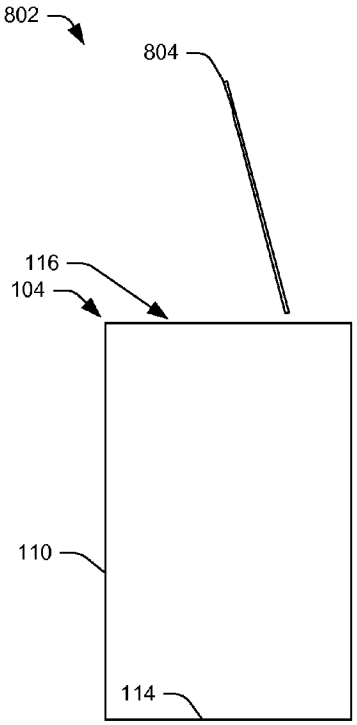
FIG. 8A illustrates an example packaging assembly including a bulk box and an inflatable bag shock absorber.
Figure 8B:
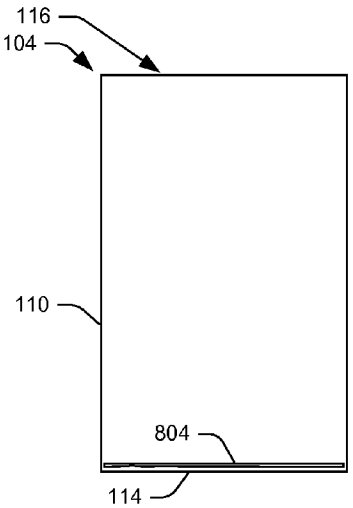
FIG. 8B illustrates the inflatable bag shock absorber disposed in the bulk box.
Figure 8C:
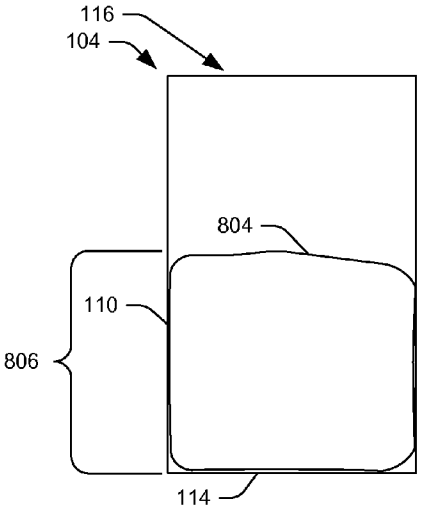
FIG. 8C illustrates the inflatable bag shock absorber filled with a gas.

FIG. 8A illustrates an example packaging assembly 802 including a bulk box 104 and an inflatable bag shock absorber 804, FIG. 8B illustrates the inflatable bag shock absorber 804 disposed in the bulk box 104, and FIG. 8C illustrates the inflatable bag shock absorber 804 filled with a gas in the bulk box 104. The inflatable bag shock absorber 804 may be formed of a plastic film (e.g., polyethylene), paper, fabric, rubber, a composite of any of the foregoing (e.g., plastic and paper), or the like.

FIG. 8B illustrates the inflatable bag shock absorber 804 may rest on the bottom 114 of the bulk box 104. FIG. 8C illustrates the inflatable bag shock absorber 804 may be pressurized with a gas (e.g., air, oxygen, nitrogen, carbon dioxide, etc.) and fill a portion 806 of the bulk box 104. For example, the inflatable bag shock absorber 804 may fill about ⅓, ½, ⅔, or ¾ of a bulk box 104.

Figures 9A, 9B, 9C:
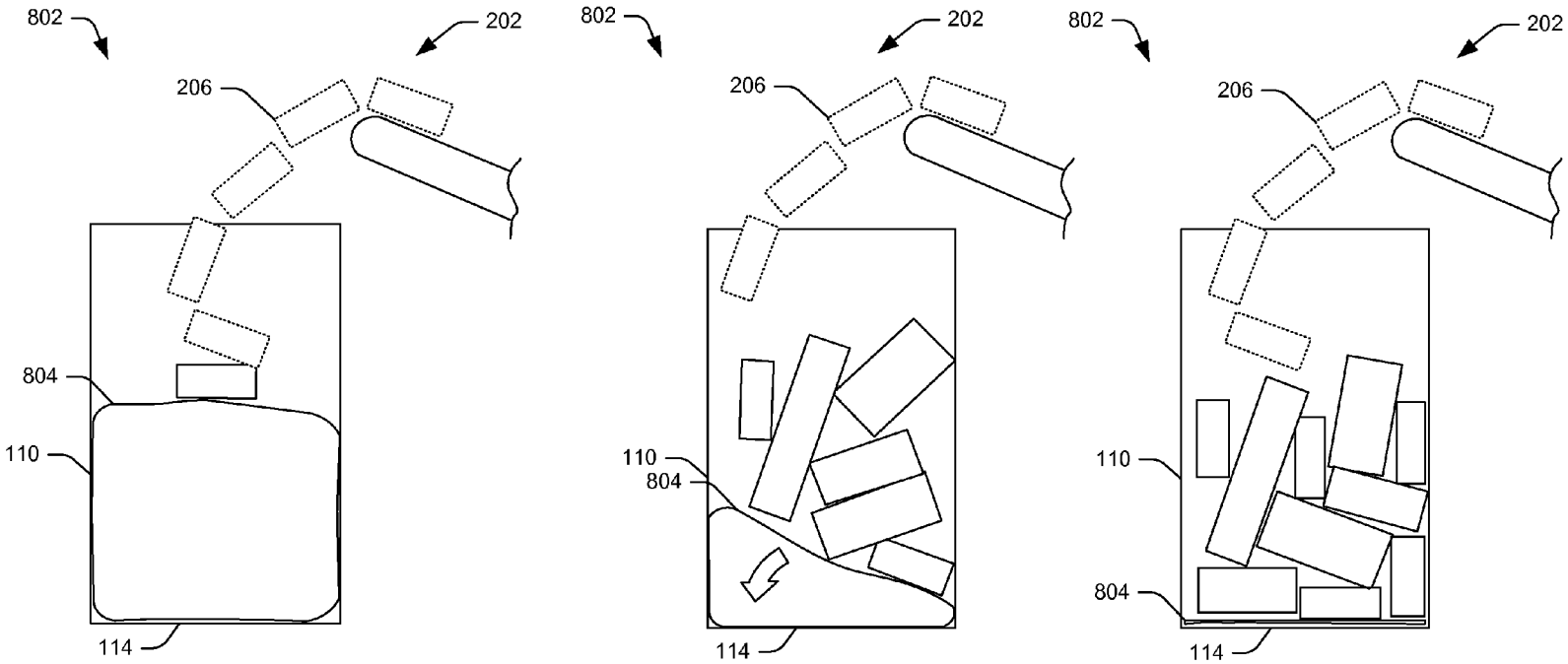
FIGS. 9A, 9B, and 9C illustrate an example implementation of the inflatable bag shock absorber of FIGS. 8A, 8B, and 8C.

FIGS. 9A, 9B, and 9C illustrate an example implementation of the inflatable bag shock absorber 804 of FIGS. 8A, 8B, and 8C. FIG. 9A illustrates a packaging assembly 802, including the bulk box 104 and the inflatable bag shock absorber 804, may be positioned proximate to a pick-up point 202. FIG. 9A illustrates a product 206 may be dispensed from the pick-up point 202 and accumulate in the bulk box 104. The inflatable bag shock absorber 804 may be positioned to first deflect the product 206 and subsequently catch the product 206 in the bulk box 104.

FIG. 9B illustrates the inflatable bag shock absorber 804 may provide to collapse under a weight of the accumulated product 206. For example, a plastic film of the inflatable bag shock absorber 804 may fail (e.g., burst, tear, or otherwise open) as a result of the accumulated product 206. Further, the inflatable bag shock absorber 804 may comprise a pressure relief valve set to open (e.g., crack) as a result of the accumulated product 206. As the product accumulates on top of the inflatable bag shock absorber 804, the weight of the accumulated product 206 causes the inflatable bag shock absorber 804 to be displaced down inside the bulk box 104.

FIG. 9C illustrates the inflatable bag shock absorber 804 may completely collapse. This provides for the product 206 to continue to accumulate in the bulk box 104.

Figures 10A, 10B, 10C:
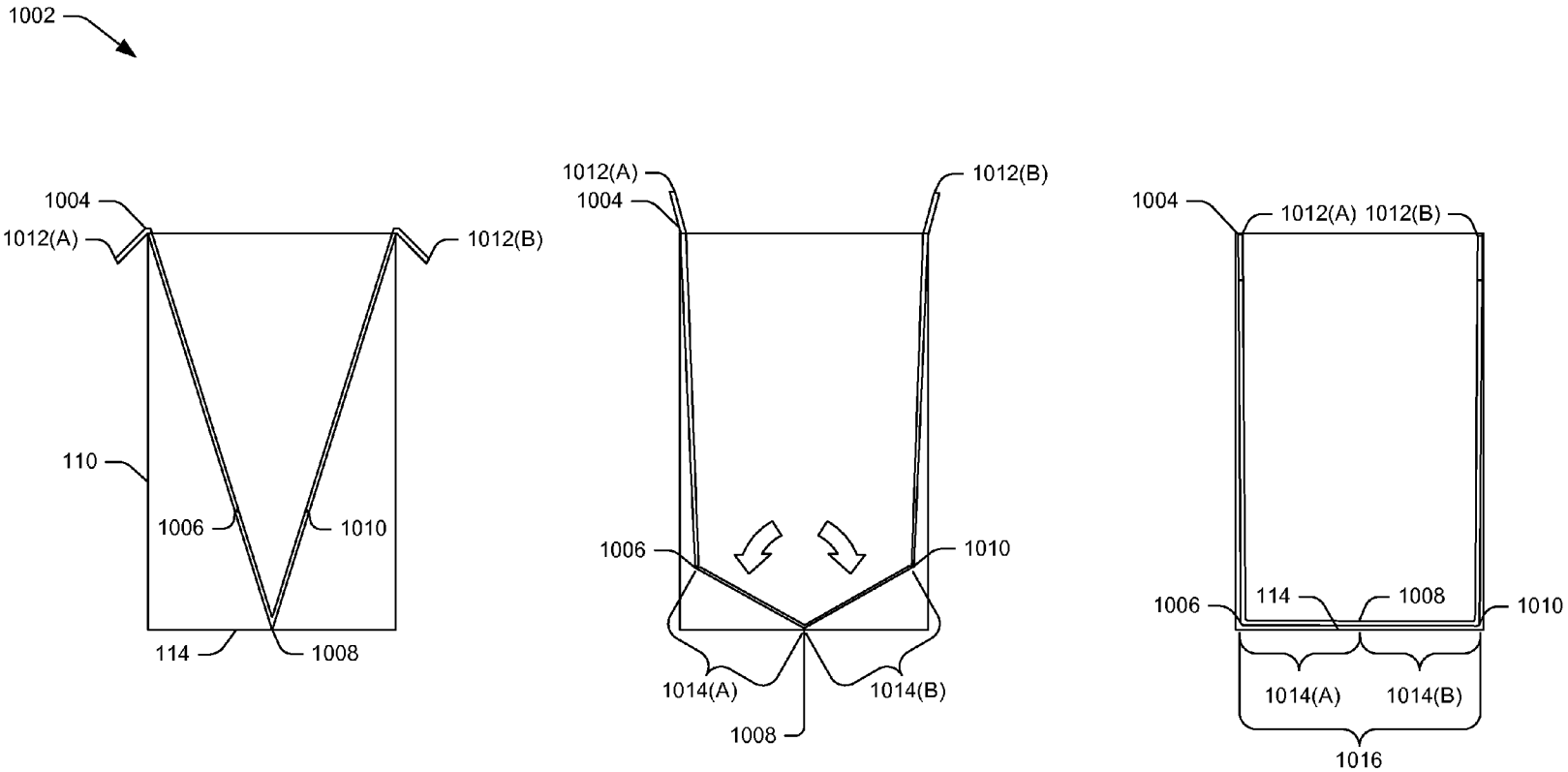
FIG. 10A illustrates an example packaging assembly including a rectangular sheet shock absorber disposed in a bulk box.
FIGS. 10B and 10C illustrate the rectangular sheet shock absorber being displaced down inside the bulk box.

FIG. 10A illustrates an example packaging assembly 1002 including a rectangular sheet shock absorber 1004 disposed in a bulk box 104, and FIGS. 10B and 10C illustrate the rectangular sheet shock absorber 1004 being displaced down inside the bulk box 104. Similar to the rectangular sheet shock absorber 106, rectangular sheet shock absorber 1004 may be formed of a corrugated fiberboard or a corrugated plastic. While FIG. 10A illustrates the rectangular sheet shock absorber 1004 having a generally v-shaped cross-section when placed in the bulk box 104, other the rectangular sheet shock absorber 1004 may have a generally z-shaped cross-section when placed in the bulk box. The rectangular sheet shock absorber 1004 may have about the same dimensions as the rectangular sheet shock absorber 106. For example, the rectangular sheet shock absorber 1004 may have a length of about 80 inches (203 centimeters) and a width of about 38 inches (96.5 centimeters). The rectangular sheet shock absorber 1004 may comprise about 3 fold lines 1006, 1008, and 1010. The 3 fold lines 1006, 1008, and 1010 may be arranged to fold as a result of an accumulation of product 206 dispensed from the pick-up point 202. The rectangular sheet shock absorber 1004 may comprise tabs 1012(A) and 1012(B). The tabs 1012(A) and 1012(B) may provide for holding the rectangular sheet shock absorber 1004 in position before product accumulates in the bulk box 104. The tabs 1012(A) and 1012(B) may provide for the rectangular sheet shock absorber 1004 to be displaced down in the bulk box 104. A tab similar to tab 1012(A) may be applied to the rectangular sheet shock absorber 106 of FIGS. 1-3.

FIG. 10B illustrates the 3 fold lines 1006, 1008, and 1010 may be arranged to provide for the rectangular sheet shock absorber 1004 to be displaced down inside the bulk box 104 as product 206 accumulates on top of the rectangular sheet shock absorber 1004.

FIG. 10C illustrates the rectangular sheet shock absorber 1004 may fold at the 3 fold lines 1006, 1008, and 1010 and provide for the rectangular sheet shock absorber 1004 to deform into two portions 1014(A) and 1014(B).

FIG. 10C illustrates the two portions 1014(A) and 1014(B) having a combined width 1016 that is about the same as the width 120 of the bulk box 104. The folded portions 1014(A) and 1014(B) of the rectangular sheet shock absorber 1004 may lay parallel with the bottom 114 of the bulk box 104. Because the folded portions 1014(A) and 1014(B) lay parallel with the bottom 114, this provides for the bulk box 104 to receive additional product 206.

Example Process of Loading a Bulk Box

Figure 11:
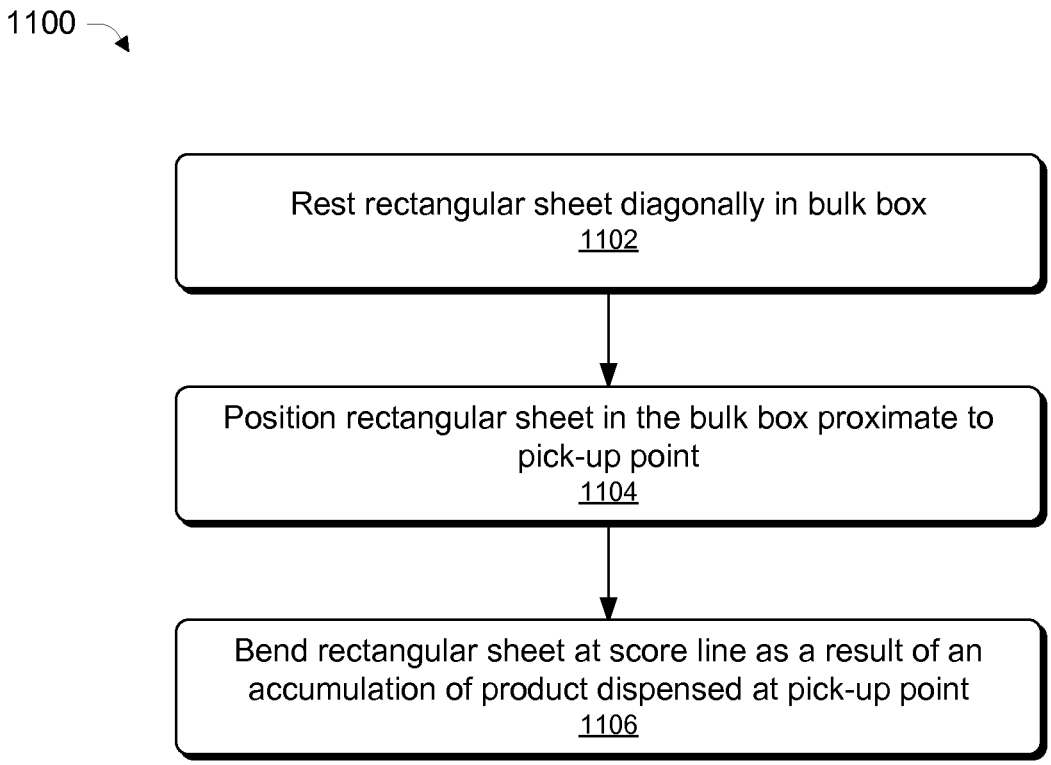
FIG. 11 is a flow diagram that illustrates an example process of loading a bulk box having a shock absorber.

FIG. 11 is a flow diagram that illustrates an example process 1100 of loading a bulk box (e.g., a Gaylord container) to be shipped to a package delivery company. For convenience, the process 1100 will be described with reference to the packaging assembly 102 having a bulk box 104 and a rectangular sheet shock absorber 106 as illustrated in FIGS. 1A and 1B, but the process 1100 is not limited to use with this system. For example, a user (e.g., a loader) may perform this process 1100 to load the packaging assembly 402 having a bulk box and a shuttle tray shock absorber 404, net, air bag, etc. Further, a user may perform this process 1100 to load packaging assembly 602, packaging assembly 802, or packaging assembly 1002. In some instances, this process may be performed in a distribution center (e.g., a fulfillment center), a package delivery company, a warehouse, a wholesale environment, or in a retail environment. While this figure illustrates an example order, it is to be appreciated that the described operations in this and all other processes described herein may be performed in other orders and/or in parallel in some instances.

Process 1100 begins at operation 1102, where a rectangular sheet (e.g., rectangular sheet shock absorber 106) is rested (e.g., laid) diagonally from about a top edge (e.g., top edge 126) of a back wall (e.g., back wall 118(B)) of the bulk box to about a bottom corner (e.g., bottom corner 128) of a front wall (e.g., front wall 118(A)) of the bulk box opposite the back wall. Process 1100 includes operation 1104, which represents positioning the rectangular sheet resting in the bulk box proximate to a pick-up point (e.g., pick-up point 202) to deflect and dampen a kinetic energy of a product 206 dispensed from the pick-up point.

Process 1100 may be completed at operation 1106 in some instances, which represents loading the bulk box with sufficient product to cause the rectangular sheet to bend at about a fold line (e.g., fold line 124) as a result of an accumulation of the product dispensed from the pick-up point.

Objective Evidence

Figure 12:
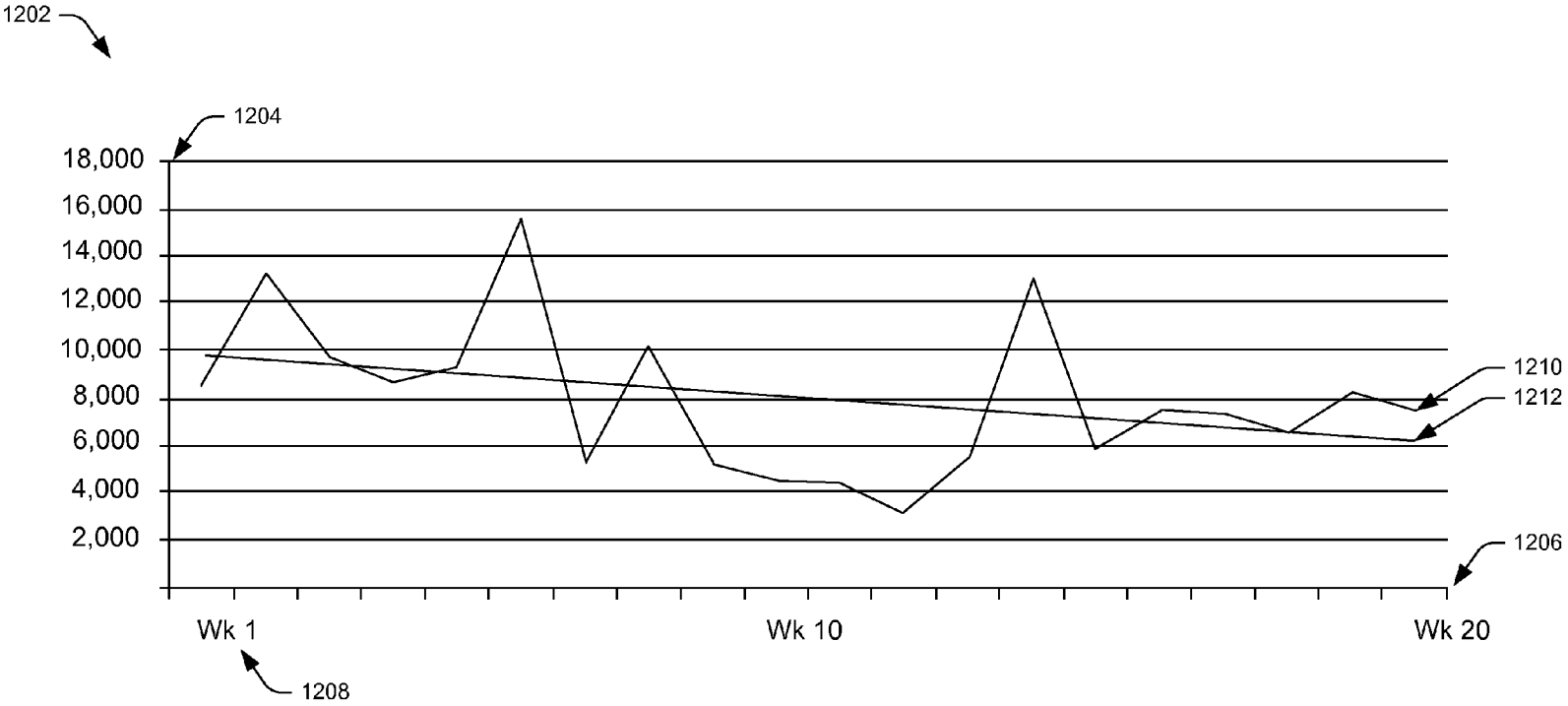
FIG. 12 is a line chart illustrating test results showing a reduction in defects over time as a result of implementing the rectangular sheet shock absorber of FIGS. 1A and 1B.

FIG. 12 is a line chart 1202 illustrating test results showing a reduction in defects of products 206 (e.g., electronic book devices) over time as a result of implementing the rectangular sheet shock absorber 106 of FIGS. 1A and 1B. In some instances, the test was performed in a distribution center (e.g., a fulfillment center). Further, the test was performed using a rectangular sheet shock absorber 106 resting in a bulk box 104 proximate to a pick-up point 202 of a conveyor system. The line chart 1202 illustrates the test results showing the reduction in defects of products 206 using the rectangular sheet shock absorber 106 to deflect and dampen a kinetic energy of the product 206 dispensed from the pick-up point 202.

The line chart 1202 includes a vertical axis 1204 representing defects per million opportunity (i.e., number of shipments) (DMPO) and a horizontal axis 1206 representing a number of weeks the test was implemented. DMPO may be calculated by the number defects of products divided by the quantity of the number of opportunities times 1,000,000. For example, at week one 1208 the distribution center under test shipped about 887 products 206, of which, 8 products 206 were replaced for free to customers. In this example, the DMPO is calculated by dividing the 8 products replaced for free by the quantity of the 887 products shipped times 1,000,000, which is a DMPO of about 9,019. The line chart 1202 includes line 1210 showing the recorded test values of DMPO of product 206 for each week. The line chart 1202 also includes a line 1212 showing a trend of line 1210, which generally shows an overall reduction in DMPO over the weeks the test was implemented. That is, the test data includes claims for defective products that were shipped both before and after implementing the shock absorber. Because the test data includes the total number of claims for defective products over time, not just products shipped after use of the shock absorber began, the line 1212 is downward sloping. The trend is expected to continue down until it reaches steady state once all damage products shipped prior to implementing the shock absorber have been returned.

Conclusion

Although the subject matter has been described in language specific to structural features and/or methodological acts, it is to be understood that the subject matter defined in the appended claims is not necessarily limited to the specific features or acts described. Rather, the specific features and acts are disclosed as example forms of implementing the claims.

What is claimed is:

1. A packaging assembly comprising:

a bulk box having a wall arranged around a perimeter of a box bottom and an aperture opposite the box bottom, the wall and the box bottom creating a cavity, the bulk box to receive product in the cavity via the aperture; and a shuttle tray having a rim arranged around a perimeter of a tray bottom, the tray bottom of the shuttle tray including tray apertures, the shuttle tray movably disposed in the cavity proximate to the aperture of the bulk box, the tray apertures to relieve an air pressure in the cavity caused by the shuttle tray moving within the cavity and toward the box bottom of the bulk box as a result of an accumulation of the product dispensed into the bulk box, the shuttle tray to provide a first coefficient of friction between a rim of the shuttle tray and the wall of the bulk box, and the shuttle tray further having tabs arranged around the perimeter of the tray bottom of the shuttle tray protruding from an outside surface of the rim to provide a second coefficient of friction between the shuttle tray and the wall of the bulk box, wherein the shuttle tray is arranged in the bulk box to dampen a kinetic energy of the product received by the bulk box.

2. The packaging assembly of claim 1, wherein at least the first coefficient of friction between the rim of the shuttle tray and the wall of the bulk box prevents the shuttle tray from moving relative to the bulk box before the accumulation of a predetermined weight of the product.

3. The packaging assembly of claim 1, wherein the bulk box is formed of corrugated material comprising a minimum edge crush test (ECT) strength of 55 and a type C-flute profile.

4. The packaging assembly of claim 1, wherein the bulk box is formed of corrugated plastic, and wherein the shuttle tray is formed of corrugated material.

5. The packaging assembly of claim 1, wherein the tray apertures are arranged in a grid on the tray bottom of the shuttle tray.

6. The packaging assembly of claim 1, wherein the wall arranged around the perimeter of the box bottom includes four wall sections that include a first wall section opposite a second wall section and a third wall section opposite a fourth wall section.

7. A bulk container for receiving product, the bulk container comprising:

a wall, arranged around a perimeter of a bottom of the bulk container, the wall having a top edge defining an aperture opposite the bottom; and a shuttle tray having a rim arranged around a perimeter of a bottom of the shuttle tray, the bottom of the shuttle tray including at least one tray aperture, the shuttle tray disposed in the aperture with the bottom of the shuttle tray being parallel with the bottom of the bulk container, the at least one tray aperture to relieve an air pressure from a cavity defined between the bottom of the shuttle tray and the bottom of the bulk container as a result of an accumulation of the product dispensed into the bulk container, the rim of the shuttle tray to provide a first coefficient of friction between the rim of the shuttle tray and the wall of the bulk container, and the shuttle tray further having tabs arranged around the perimeter of the bottom of the shuttle tray protruding from an outside surface of the rim to provide a second coefficient of friction between the shuttle tray and the wall of the bulk container.

8. The bulk container of claim 7, wherein the shuttle tray is arranged in the bulk container to dampen a kinetic energy of the product received by the bulk container.

9. The bulk container of claim 7, wherein the bottom of the shuttle tray includes a grid of multiple apertures including the at least one tray aperture, wherein the multiple apertures have a diameter between 0.5 inches and 3 inches.

10. The bulk container of claim 7, wherein the bottom of the shuttle tray includes a length and a width that are about equal to a length and a width of the bottom of the bulk container, respectively.

11. The bulk container of claim 7, wherein the rim of the shuttle tray includes flaps in contact with the wall of the bulk container, the flaps having a predetermined depth.

12. The bulk container of claim 7, wherein the product is prevented from entering the cavity between the shuttle tray and the bottom of the box.

13. A bulk box for receiving product, the bulk box comprising:

a wall, arranged around a perimeter of a bottom of the bulk box, the wall having a top edge defining an aperture opposite the bottom; and a shuttle tray having a rim arranged around a perimeter of a bottom of the shuttle tray, the bottom of the shuttle tray including a grid of tray apertures, the shuttle tray disposed in the aperture at a first position in the bulk box proximate to the top edge with the rim in contact with the wall of the bulk box, the grid of tray apertures to allow airflow from a cavity defined between the bottom of the shuttle tray and the bottom of the bulk box as a result of movement of the shuttle tray toward a second position within the bulk box, and the shuttle tray further having tabs arranged around the perimeter of the bottom of the shuttle tray protruding from a first outside surface of the rim and a second outside surface of the rim opposite the first outside surface to provide a coefficient of friction between the shuttle tray and the wall of the bulk box.

14. The bulk box of claim 13, wherein the grid of tray apertures is configured to pneumatically dampen the movement of the shuttle tray from the first position to the second position.

15. The bulk box of claim 13, wherein the coefficient of friction is a first coefficient of friction, and wherein the rim of the shuttle tray is configured to provide a second coefficient of friction between the rim of the shuttle tray and the wall of the bulk box, at least the first coefficient of friction or the second coefficient of friction to maintain the shuttle tray at the first position in the bulk box before an accumulation of a predetermined weight of the product.

16. The bulk box of claim 13, wherein the bulk box is formed of a corrugated fiberboard.

17. The bulk box of claim 13, wherein the bulk box is coupled to a pallet.

* * * * *